US008551301B2

(12) United States Patent
Neff et al.

(10) Patent No.: US 8,551,301 B2
(45) Date of Patent: Oct. 8, 2013

(54) ELECTROPLATING SYSTEM WITH ELECTROPLATING WHEEL

(75) Inventors: Mark William Neff, Kernersville, NC (US); David Jose de Miranda, Greensboro, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 629 days.

(21) Appl. No.: 12/565,538

(22) Filed: Sep. 23, 2009

(65) Prior Publication Data

US 2010/0084264 A1 Apr. 8, 2010

Related U.S. Application Data

(60) Provisional application No. 61/195,563, filed on Oct. 8, 2008.

(51) Int. Cl.
*C25D 17/00* (2006.01)
*C25D 5/02* (2006.01)

(52) U.S. Cl.
USPC ..... 204/202; 204/198; 204/206; 205/129

(58) Field of Classification Search
USPC ..... 204/202, 206; 205/129
See application file for complete search history.

(56) References Cited

U.S. PATENT DOCUMENTS

| | | | | |
|---|---|---|---|---|
| 3,819,502 | A | 6/1974 | Meuldijk et al. | |
| 4,687,555 | A * | 8/1987 | Smith | 205/128 |
| 5,188,720 | A * | 2/1993 | Colin et al. | 204/206 |
| 5,804,053 | A * | 9/1998 | Vaccaro et al. | 205/138 |

* cited by examiner

*Primary Examiner* — Keith Hendricks
*Assistant Examiner* — Stefanie Sherrill

(57) ABSTRACT

An electroplating system is provided for electroplating a workpiece. The system includes a plating wheel having a side and a cylindrical wall extending from the side. The plating wheel has an interior chamber that at least partially defines a solution chamber that is configured to hold an electroplating solution. The cylindrical wall includes an opening extending through the cylindrical wall into fluid communication with the interior chamber. An external anode is located proximate to and positioned outside the cylindrical wall of the plating wheel to define an electroplating work area therebetween. An internal anode is held within the interior chamber of the plating wheel and positioned to align with the work area.

20 Claims, 5 Drawing Sheets

ELECTROPLATING SYSTEM WITH ELECTROPLATING WHEEL

CROSS-REFERENCE TO RELATED APPLICATIONS

This application claims the benefit of U.S. Provisional Patent Application Ser. No. 61/195,563, filed Oct. 8, 2008, which is hereby incorporated by reference in its entirety.

BACKGROUND OF THE INVENTION

The subject matter described and/or illustrated herein relates generally to electroplating systems, and, more particularly, to electroplating systems having plating wheels.

Plated components are used in a wide variety of applications. For example, plated contacts and conductors are used in electrical connectors and other electronic components. Electroplating is one example of a plating process used to plate conductive workpieces with a layer of material, such as a metal. Electroplating uses electrical current to reduce cations of the desired plate material from an electroplating solution and coat the workpiece with the plate material. Some electroplating systems use a plating wheel to distribute the electroplating solution onto the workpiece. The plating wheel includes a cylindrical wall that extends about a circumference of the plating wheel and an interior chamber that holds the electroplating solution. The cylindrical wall includes one or more openings that fluidly communicate with the interior chamber. As the plating wheel rotates, the electroplating solution is sprayed through the opening(s) onto the workpiece.

At least some known plating wheels include a mask for shielding non-plating areas of the workpiece where plating is not desired. Specifically, the mask is intended to prevent the electroplating solution from wetting the non-plating areas by shielding the non-plating areas from the electroplating solution. The mask includes one or more openings that allow the electroplating solution to pass through the mask onto plating areas of the workpiece where plating is desired. Known masks for plating wheels include a side that engages an exterior face of the cylindrical wall of the wheel and an opposite side that engages the workpiece. The mask is thereby sandwiched between the exterior face of the cylindrical wall and the workpiece. However, the mask may not adequately seal against the workpiece, which may enable the electroplating solution to wick between the mask and the non-plating areas of the workpiece. Contact between the electroplating solution and the non-plating areas may undesirably plate such areas with the plating material. Moreover, known plating wheels can only plate from one side of the workpiece at a time. To plate from the opposite side of the workpiece, a second plating wheel is arranged on the opposite side of the workpiece. The second plating wheel adds another component to the electroplating systems and may increase cost, complexity, and/or difficulty of plating the workpiece. In alternative to the second plating wheel, the workpiece is plated in two separate operations. Specifically, the workpiece is first plated on one side using the plating wheel thereafter flipped over to plate the opposite side of the workpiece using the same plating wheel. Plating the workpiece in two separate operations using the same plating wheel may increase plating time, cost, complexity, and/or difficulty of plating the workpiece.

BRIEF DESCRIPTION OF THE INVENTION

In one embodiment, an electroplating system is provided for electroplating a workpiece. The system includes a plating wheel having a side and a cylindrical wall extending from the side. The plating wheel has an interior chamber that at least partially defines a solution chamber that is configured to hold an electroplating solution. The cylindrical wall includes an opening extending through the cylindrical wall into fluid communication with the interior chamber. An external anode is located proximate to and positioned outside the cylindrical wall of the plating wheel to define an electroplating work area therebetween. An internal anode is held within the interior chamber of the plating wheel and positioned to align with the work area.

In another embodiment, an electroplating system is provided for electroplating a workpiece. The system includes a plating wheel having a side and a cylindrical wall extending from the side. The cylindrical wall includes an exterior face extending about a circumference of the plating wheel. The plating wheel has an interior chamber that at least partially defines a solution chamber that is configured to hold an electroplating solution. The cylindrical wall includes openings extending through the cylindrical wall into fluid communication with the interior chamber. Ribs extend outwardly from the exterior face of the cylindrical wall. The ribs are spaced apart from one another about the circumference of the plating wheel. The ribs are configured to engage the workpiece to create an air gap between the workpiece and the exterior face of the cylindrical wall.

In another embodiment, an electroplating system includes a plating wheel having a side and a cylindrical wall extending from the side. The cylindrical wall includes an exterior face. The plating wheel has an interior chamber that at least partially defines a solution chamber that is configured to hold an electroplating solution. The cylindrical wall includes an opening extending through the cylindrical wall into fluid communication with the interior chamber. A workpiece is held by the plating wheel. The workpiece is spaced apart from the exterior face of the cylindrical wall of the plating wheel by an air gap.

DETAILED DESCRIPTION OF THE INVENTION

Figure 1:
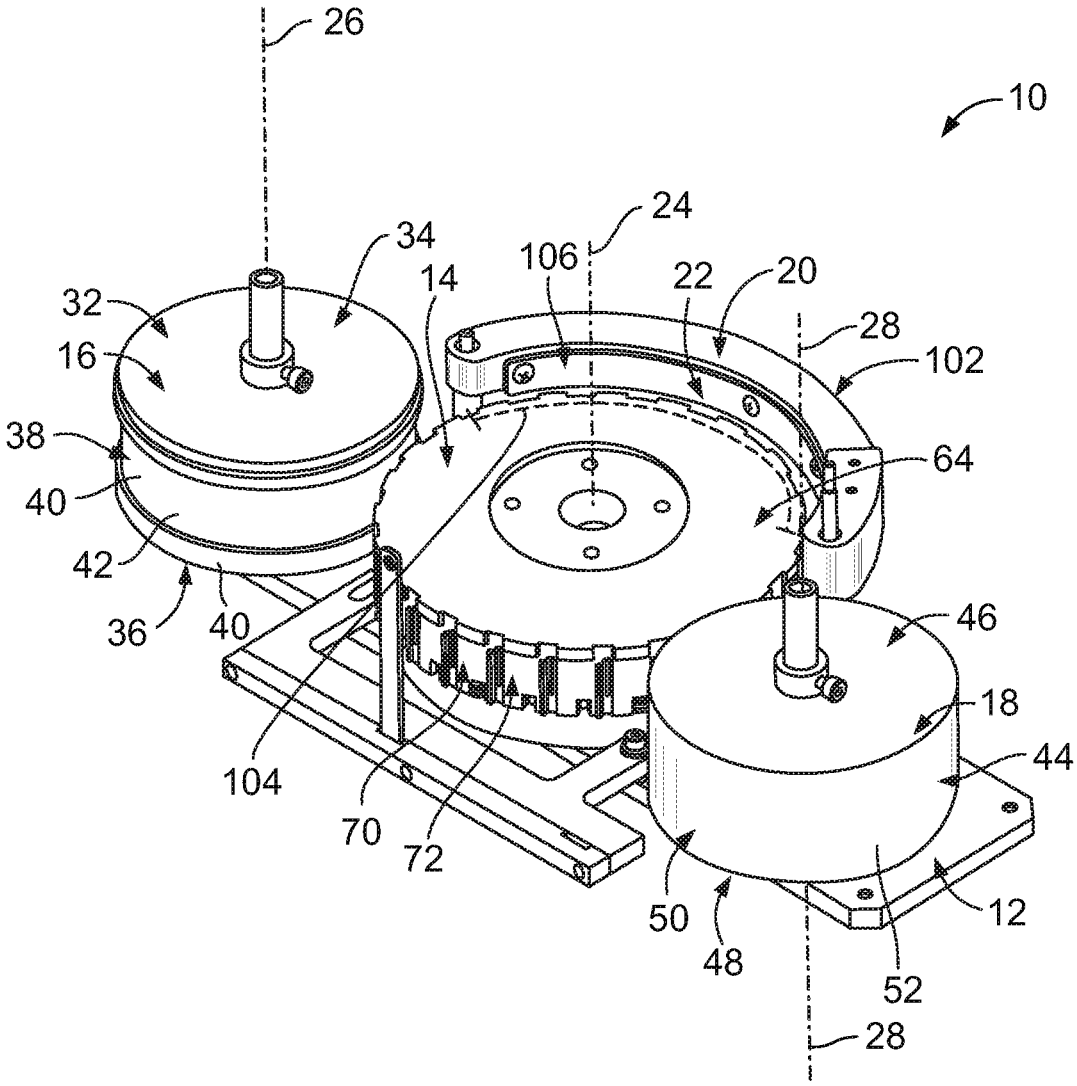
FIG. 1 is a perspective view of an exemplary embodiment of an electroplating system for electroplating a workpiece.
Figure 2:
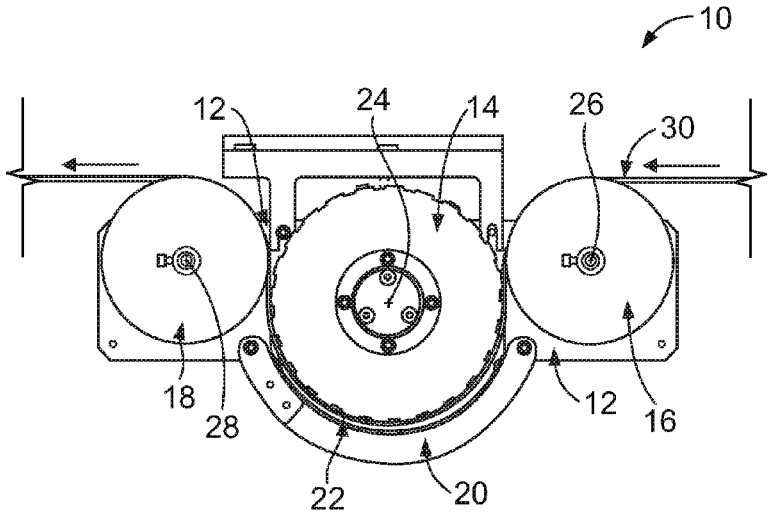
FIG. 2 is a plan view of the electroplating system shown in FIG. 1.

FIG. 1 is a perspective view of an exemplary embodiment of an electroplating system 10 for electroplating a workpiece 30 (FIGS. 2, 3, and 7) with a plating material. FIG. 2 is a plan view of the electroplating system 10. The electroplating system 10 includes a base 12, a plating wheel 14, an input guide pulley 16, an output guide pulley 18, and an external anode 20. An electroplating work area 22 is defined between the plating wheel 14 and the external anode 20. The plating wheel 14, the input guide pulley 16, and the output guide pulley 18 are each mounted on the base 12 for rotation relative to the base 12 about a respective axis of rotation 24, 26, and 28. A workpiece 30 is held by the plating wheel 14, the input guide pulley 16, and the output guide pulley 18. As the plating wheel 14 rotates about the axis of rotation 24, the input guide pulley 16 guides the workpiece 30 into engagement with the plating wheel 14 and into the electroplating work area 22. As will be described below, the workpiece 30 is plated with the plating material as the workpiece 30 is routed through the electroplating work area 22. The output guide pulley 18 guides the workpiece 30 as the workpiece 30 exits the electroplating work area 22. Rotation of the plating wheel 14 is driven by the forward motion of the workpiece 30 as the workpiece 30 is pulled through the electroplating work area 22.

Referring now to FIG. 1, the input guide pulley 16 includes a body 32 having opposite sides 34 and 36 connected by a cylindrical wall 38. The cylindrical wall 38 includes an exterior face 40 that extends about a circumference of the body 32. The exterior face 40 of the body 32 includes an optional channel 42 for receiving the workpiece 30 (FIGS. 2, 3, and 7) therein. In the exemplary embodiment, rotation of the input guide pulley 16 about the axis of rotation 26 is not driven, but rather is passive. For example, one or more bearings (not shown) may be operatively connected between the body 32 of the input guide pulley 16 and the base 12. Engagement between the workpiece 30 and the body 32 of the input guide pulley 16 rotates the input guide pulley 16 about the axis of rotation 26 as the workpiece 30 is pulled through the electroplating work area 22.

The output guide pulley 18 includes a body 44 having opposite sides 46 and 48 connected by a cylindrical wall 50. The cylindrical wall 50 includes an exterior face 52 that extends about a circumference of the body 44. Optionally, the body 44 includes a channel (not shown) for receiving the workpiece 30 therein. Similar to the input guide pulley 16, rotation of the output guide pulley 18 about the axis of rotation 28 is passively driven via engagement between the workpiece 30 and the body 44 as the workpiece 30 is pulled through the electroplating work area 22.

Figure 3:
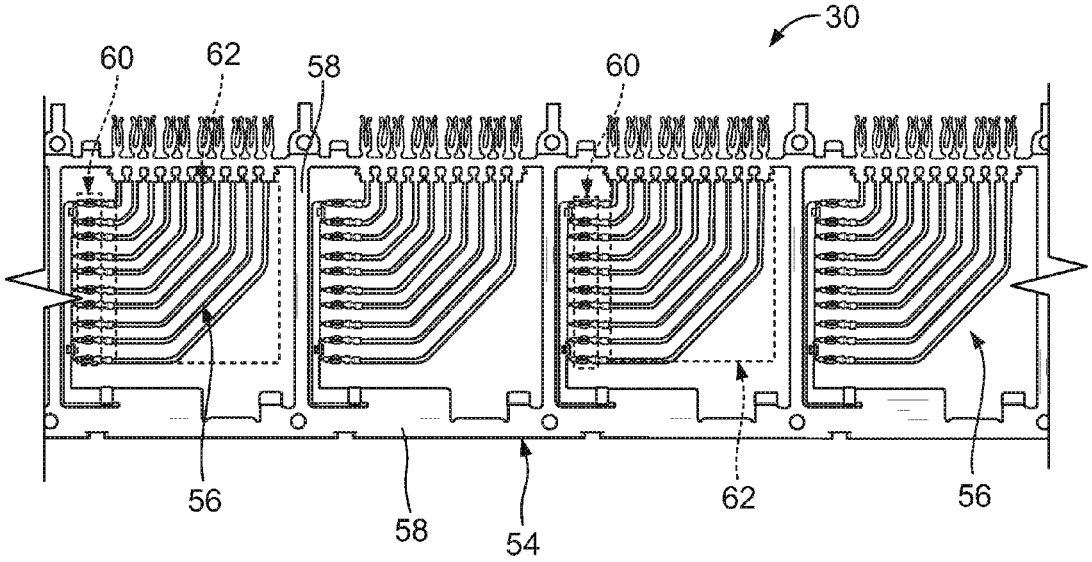
FIG. 3 is a plan view of a portion of an exemplary workpiece.

FIG. 3 is plan view of a portion of an exemplary workpiece 30. In the exemplary embodiment, the workpiece 30 includes a strip 54 of a plurality of lead frames 56 for one or more electrical connectors (not shown). The lead frames 56 are held together by carrier strips 58. Each lead frame 56 includes a plating area 60 and a non-plating area 62. The plating areas 60 are plated with a plating material using the electroplating system 10 (FIGS. 1 and 2). The non-plating areas 62 are areas on the lead frames 56 that are not desired to be plated with the plating material. The lead frames 56 are merely examples of workpieces 30 that may be electroplated using the electroplating system 10. The electroplating system 10 may be used to plate any other type of workpiece having any other structure, material composition, components, size, shape, geometry, and/or the like. Moreover, the plating areas 60 of the exemplary workpiece 30 and/or any other workpiece electroplated using the electroplating system 10 may be plated with any plating material, such as, but not limited to, any metal(s).

Figure 4:
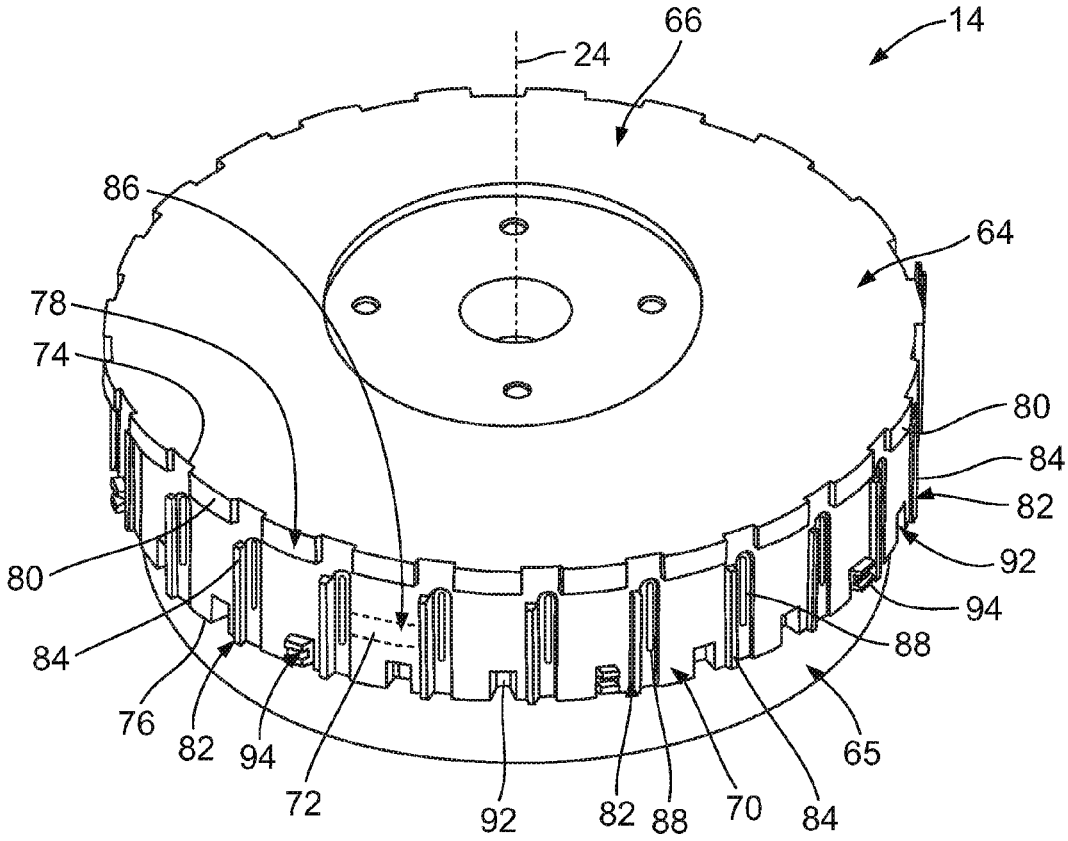
FIG. 4 is a perspective view of an exemplary embodiment of a plating wheel of the electroplating system shown in FIGS. 1 and 2.
Figure 5:
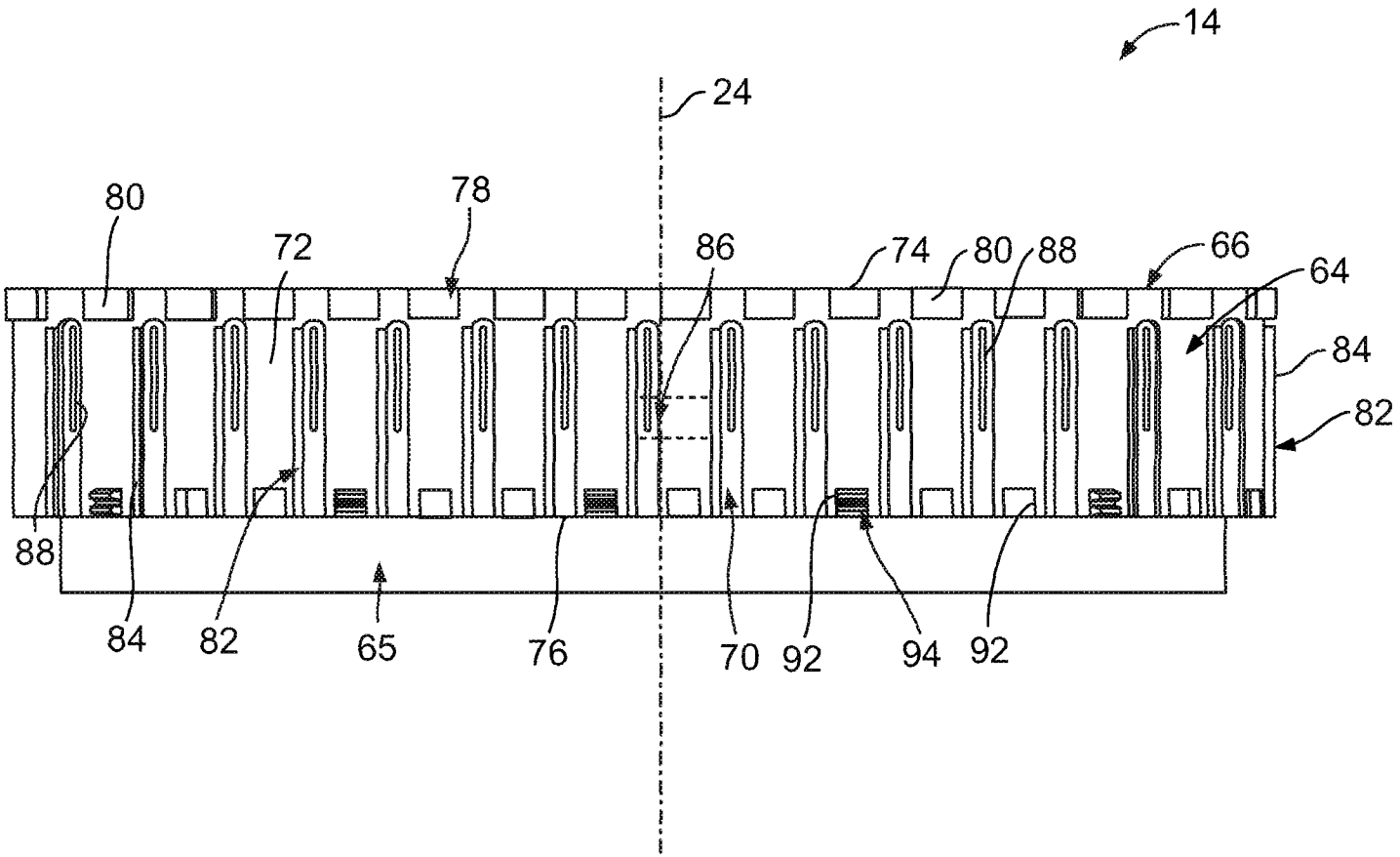
FIG. 5 is an elevational view of the plating wheel shown in FIG. 4.

FIG. 4 is a perspective view of an exemplary embodiment of the plating wheel 14. FIG. 5 is an elevational view of the plating wheel 14. The plating wheel 14 includes a body 64 having a side 66 and a cylindrical wall 70 extending from the side 66. The cylindrical wall 70 extends about a circumference of the body 64 and includes an exterior face 72. The cylindrical wall 70 extends, and is centered, about the axis of rotation 24. The cylindrical wall 70 intersects the side 66 at an edge 74, and extends from the edge 74 to an opposite edge 76. The exterior face 72 of the cylindrical wall 70 extends from the edge 74 to the edge 76. As the body 64 of the plating wheel 14 rotates about the axis of rotation 24, the body 64 of the plating wheel 14 rotates about a stationary solution chamber body 65 that is mounted on the base 12. As will be described below, the solution chamber body 65 is configured to hold an electroplating solution 91 (FIGS. 6 and 7) for plating the workpiece 30 with the plating material. One or more bearings (not shown) may be operatively connected between the body 64 of the plating wheel 14 and the base 12 and/or between the plating wheel body 64 and the solution chamber body 65. The side 66 of the body 64 may be referred to herein as a "top side". The edges 74 and 76 may each be referred to herein as a "top edge" and a "bottom edge", respectively.

A plurality of ribs 82 extend outwardly from the exterior face 72 of the cylindrical wall 70. The ribs 82 are spaced apart from one another about the circumference of the body 64. Although shown as being spaced evenly apart about the circumference of the body 64, some or all of the ribs 82 may alternatively be unevenly spaced apart about the circumference of the body 64. The body 64 may include any number of ribs 82. Each of the ribs 82 includes an exterior surface 84 that is spaced apart from the exterior face 72 of the cylindrical wall 70. Specifically, the exterior surfaces 84 are spaced radially outward from the exterior face 72 relative to the axis of rotation 24. The exterior surfaces 84 of the ribs 82 are each configured to engage the workpiece 30 (FIGS. 2, 3, and 7) to space the workpiece 30 from the exterior face 72 of the cylindrical wall 70. Specifically, the exterior surfaces 84 of the ribs 82 are each configured to engage the workpiece 30 to space the workpiece 30 radially outward from the exterior face 72 relative to the axis of rotation 24.

In the exemplary embodiment, each of the ribs 82 extends a length from the edge 76 of the cylindrical wall 70 toward the edge 74. Moreover, in the exemplary embodiment, the length of each rib 82 overlaps an intermediate section 86 of the exterior face 72 that extends between the edges 74 and 76. Each rib 82 thus overlaps a center of a height of the exterior face 72, with the height of the exterior face 72 being defined from the edge 74 to the edge 76. Further, in the exemplary embodiment, the length of each rib 82 extends between an optional flange 78 of the plating wheel body 64 and the edge 76. However, in alternative to how the ribs 82 are shown in the exemplary embodiment, the length of each rib 82 may extend along any location(s) of the height of the exterior face 72 of the cylindrical wall 70. In some embodiments, the length of one or more of the ribs 82 is separated into two or segments that are spaced apart from each other along the height of the exterior face 72 of the cylindrical wall 70.

The length of each rib 82 extends generally parallel to the axis of rotation 24 in the exemplary embodiment. However, the length of each rib 82 may extend at any angle relative to the axis of rotation 24. Moreover, in the exemplary embodiment, each rib 82 has a rectangular shape. However, each rib 82 may additionally or alternatively include any other shape than rectangular. The size of each rib 82 is meant as exemplary only. Specifically, each rib 82 may have any size.

The flange 78 extends outwardly from the exterior face 72 of the cylindrical wall 70 proximate the edge 74. In the exemplary embodiment, the flange 78 includes a plurality of individual extensions 80 that are spaced apart from each other about the circumference of the body 64. Alternatively, the flange 78 extends continuously about the circumference of the body 64. Although shown as being spaced evenly apart about the circumference of the body 64, some or all of the extensions 80 of the flange 78 may alternatively be unevenly spaced apart about the circumference of the body 64. The body 64 may include any number of the flange extensions 80. Each of the extensions 80 of the flange 78 includes an exterior surface that is spaced apart from the exterior face 72 of the cylindrical wall 70. Specifically, the exterior surfaces of the flange extensions 80 are spaced radially outward from the exterior face 72 relative to the axis of rotation 24. The exterior surfaces of the flange extensions 80 are each configured to engage the workpiece 30 to space the workpiece 30 from the exterior face 72 of the cylindrical wall 70. Specifically, the exterior surfaces of the flange extensions 80 are each configured to engage the workpiece 30 to space the workpiece 30 radially outward from the exterior face 72 relative to the axis of rotation 24. The size of each flange extension 80 is meant as exemplary only. Specifically, each flange extension 80 may have any size. In addition or alternative to the flange 78, the body 64 of the plating wheel 14 may include a flange (not shown) proximate the edge 76.

A plurality of openings 88 extend through the cylindrical wall 70 into fluid communication with an interior chamber 90 (FIGS. 6 and 7) of the body 64 of the plating wheel 14. The openings 88 are spaced apart from one another about the circumference of the body 64. In the exemplary embodiment, the openings 88 are shown as being spaced evenly apart about the circumference of the body 64. Some or all of the openings 88 may alternatively be unevenly spaced apart about the circumference of the body 64. The body 64 may include any number of openings 88. In the exemplary embodiment, each of the openings 88 extends a length between the edges 74 and 76 of the cylindrical wall 70. Moreover, in the exemplary embodiment, the length of each opening 88 overlaps the intermediate section 86 of the exterior face 72. However, in alternative to how the openings 88 are shown in the exemplary embodiment, the length of each opening 88 may extend along any location(s) of the height of the exterior face 72 of the cylindrical wall 70. In some embodiments, the length of one or more of the openings 88 is separated into two or segments that are spaced apart from each other along the height of the exterior face 72 of the cylindrical wall 70. In the exemplary embodiment, the length of each opening 88 extends generally parallel to the axis of rotation 24. Alternatively, the length of one or more of the openings 88 extends at any other angle relative to the axis of rotation 24. Each opening 88 may include any shape(s) and/or any size(s) in addition or alternative to the shape and size shown in the exemplary embodiment.

The body 64 of the plating wheel 14 includes a plurality of optional features 92 for holding locating teeth 94. In the exemplary embodiment, the features 92 extend proximate the edge 76 of the cylindrical wall 70. Alternatively, one or more of the features 92 extend proximate another location of the cylindrical wall, such as, but not limited to, the edge 74. The features 92 are spaced apart from one another about the circumference of the body 64. The features 92 may be evenly spaced apart about the circumference of the body 64 or some or all of the features 92 may be unevenly spaced apart about the circumference of the body 64. In the exemplary embodiment, every third feature 92 holds one or more locating teeth 94 that are configured to engage the workpiece 30 to locate the workpiece 30 relative to the cylindrical wall 70. However, any number of the features 92 may hold locating teeth 94. The body 64 may include any number of features 92 for holding any number of locating teeth 94. In the exemplary embodiment, the features 92 are openings, however, one or more of the features 92 may additionally or alternative include any other structure than an opening, such as, but not limited to, a post, an extension, and/or the like. In some alternative embodiments, one or more of the locating teeth 94 is formed integrally with the cylindrical wall 70.

Figure 6:
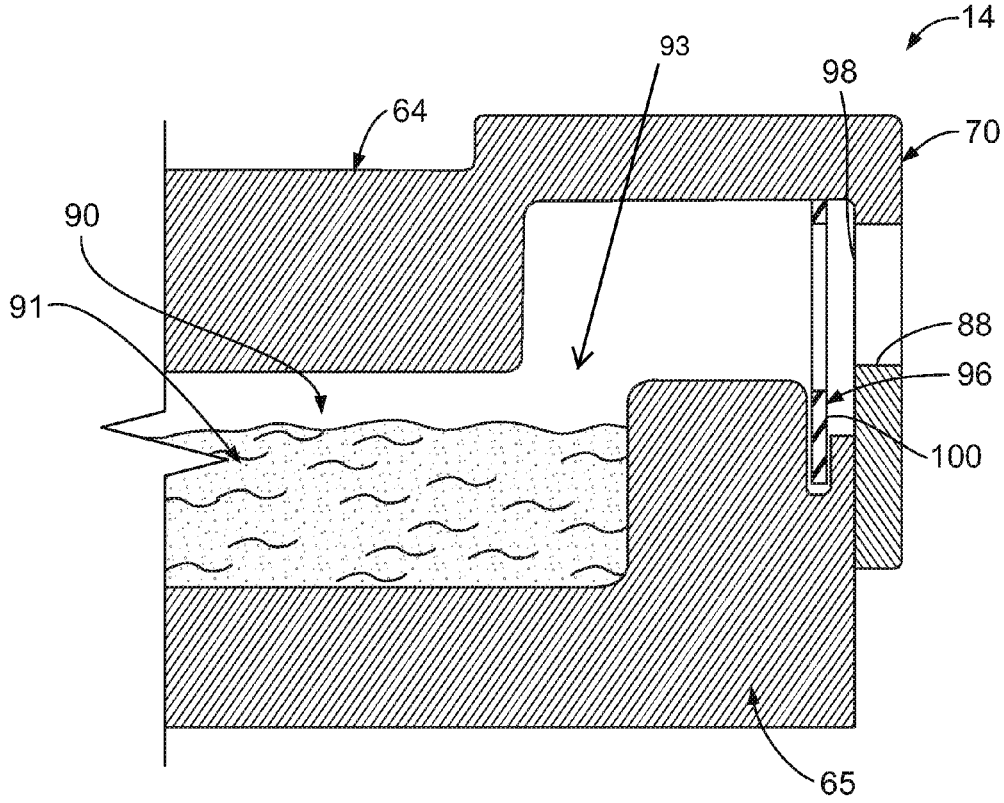
FIG. 6 is cross-sectional view of a portion of the plating wheel shown in FIGS. 4 and 5.

FIG. 6 is cross-sectional view of a portion of the plating wheel 14. The body 64 of the plating wheel 14 includes the interior chamber 90. The solution chamber body 65 is received at least partially within the interior chamber 90 of the plating wheel body 64 such that a solution chamber 93 is defined between the solution chamber body 65 and the plating wheel body 64. The solution chamber 93 is configured to hold an electroplating solution 91. The electroplating solution 91 is an electrolyte that contains one or more dissolved metal salts and/or other ions that permit the flow of electricity. The electroplating solution 91 may contain any ingredients and/or materials for plating the workpiece 30 (FIGS. 1, 2, and 7) with any desired plating material. In some embodiments, the electroplating solution 91 includes ions of the plating material.

Figure 7:
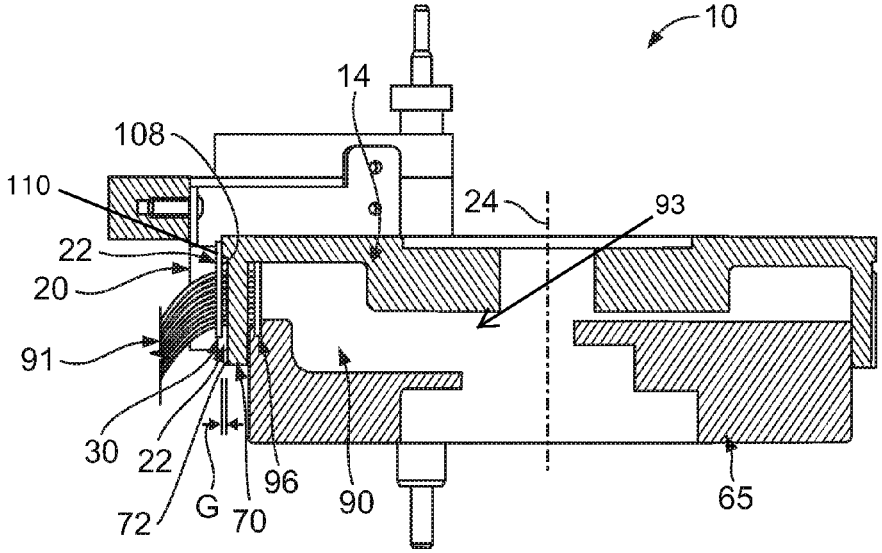
FIG. 7 is a cross-sectional view of the electroplating system shown in FIGS. 1 and 2.

An internal anode 96 is held within the solution chamber 93. The internal anode 96 extends within the solution chamber 93 along the circumference of the plating wheel body 64 proximate an interior face 98 of the cylindrical wall 70. The internal anode 96 is thus positioned to align with the electroplating work area 22 (FIGS. 1, 2, and 7). The internal anode 96 includes one or more openings 100 extending therethrough such that the openings 88 within the cylindrical wall 70 fluidly communicate with the solution chamber 93. The internal anode 96 is operatively connected to a rectifier (not shown) and/or another source of electrical power. In some embodiments, the internal anode 96 is at least partially fabricated from the plating material. In other embodiments, the internal anode 96 is a non-consumable anode that is fabricated from different material(s) than the plating material.

Referring again to FIG. 1, the external anode 20 is located proximate to and positioned outside the cylindrical wall 70 of the plating wheel 14. The external anode 20 includes a body 102 that is mounted on the base 12 such that the external anode 20 remains stationary relative to the base 12 as the plating wheel 14 rotates about the axis of rotation 24. The body 102 of the external anode 20 extends partially along the circumference of the body 64 of the plating wheel 14. Specifically, the body 102 of the external anode 20 extends around an electroplating section 104 of the cylindrical wall 70 of the plating wheel 14. It should be understood that the position of the electroplating section 104 of the cylindrical wall 70 of the plating wheel 14 is constantly moving around the circumference of the plating wheel 14, and thus constantly changing, as the plating wheel 14 rotates about the axis of rotation 24.

The external anode 20 has an annular face 106 that faces the exterior face 72 of the cylindrical wall 70. The electroplating work area 22 is defined between the annular face 106 of the external anode 20 and the exterior face 72 of the cylindrical wall 70. Specifically, the annular face 106 of the external anode 20 is concentrically aligned with the cylindrical wall 70 about the axis of rotation 24. However, the annular face 106 of the external anode 20 has a greater radius than the exterior face 72 of the cylindrical wall 70 such that the annular face 106 is spaced radially apart from the exterior face 72 to define the electroplating work area 22 therebetween. The body 102 of the external anode 20 optionally includes a mesh structure (not shown) for allowing the electroplating solution 91 to pass through the body 102 of the external anode 20 during electroplating of the workpiece 30 (FIGS. 1, 2, and 7).

The external anode 20 is operatively connected to a rectifier (not shown) and/or another source of electrical power. In some embodiments, the external anode 20 is at least partially fabricated from the plating material. In other embodiments, the external anode 20 is a non-consumable anode that is fabricated from different material(s) than the plating material.

FIG. 7 is a cross-sectional view of the electroplating system 10. In operation, as plating wheel 14 rotates and the workpiece 30 is routed through the electroplating work area 22, the ribs 82 (FIGS. 4 and 5) engage a side 108 of the workpiece 30 to create an air gap G between the workpiece 30 and the exterior face 72 of the cylindrical wall 70 of the plating wheel 14. In the exemplary embodiment, the flange 78 (FIGS. 4 and 5) also engages the side 108 of the workpiece 30 to create the air gap G. In other embodiments, the plating wheel 14 does not include the flange 78 and/or the flange 78 does not engage the workpiece 30 to create the air gap G. Electroplating solution 91 is fed into the solution chamber 93. As the plating wheel 14 rotates, the electroplating solution 91 within the solution chamber 93 flows through/around the internal anode 96 and through the openings 88 (FIGS. 4-6) within the cylindrical wall 70. The electroplating solution flowing through the openings 88 creates a stream of the electroplating solution 91 spraying radially outward (relative to the axis 24) from the cylindrical wall 70. The stream of electroplating solution 91 passes through the plating area 60 (FIG. 3) of the workpiece 30, continues past the workpiece 30, and makes contact with the external anode 20. In some embodiments the electroplating solution 91 passes through the external anode 20, while in other embodiments the electroplating solution 91 does not pass through the external anode 20. The internal anode 96 and the electroplating solution 91 react to coat, or plate, the side 108 of the workpiece 30 with the plating material. The external anode 20 and the electroplating solution 91 react to plate a side 110 of the workpiece 30 that is opposite the side 108 with the plating material. Although the internal anode 96 and the external anode 20 are described herein as plating the sides 108 and 110, respectively, of the workpiece 30, it should be understood that the internal anode 96 may also partially plate the side 110 and that the external anode 20 may also partially plate the side 108.

In some embodiments, the electroplating system indicates an alarm or signal when the workpiece becomes improperly located, or dislodged, relative to the cylindrical wall 70 of the plating wheel 14. For example, when the workpiece becomes improperly located, or dislodged, relative to the cylindrical wall 70, the plating wheel 14 may plate non-plating areas 62 (FIG. 3) of the workpiece 30. As the non-plating areas 62 of the workpiece 30 are plated, a voltage in a plating circuit (not shown) of the electroplating system 10 increases. The electroplating system 10 may sense such an increase in voltage and issue an alarm or signal if the voltage exceeds a predetermined threshold.

The embodiments described and/or illustrated herein may provide an electroplating system that simultaneously plates more than one side of a workpiece using a single plating wheel. The embodiments described and/or illustrated herein may provide an electroplating system that is less likely to plate non-plating areas of a workpiece where plating is not desired. The embodiments described and/or illustrated herein may provide an electroplating system having fewer components than at least some known electroplating systems. The embodiments described and/or illustrated herein may provide an electroplating system that plates a workpiece without using a mask. The embodiments described and/or illustrated herein may provide an electroplating system that is less costly, less complex, takes less time, and/or wherein plating is less difficult than at least some known electroplating systems.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electroplating system for electroplating a workpiece, said system comprising:

a plating wheel having a side and a cylindrical wall extending from the side, the plating wheel having an interior chamber that at least partially defines a solution chamber that is configured to hold an electroplating solution, the cylindrical wall comprising an opening extending through the cylindrical wall into fluid communication with the interior chamber, the cylindrical wall comprising an exterior face, the plating wheel comprising ribs extending outwardly from the exterior face of the cylindrical wall, the ribs being spaced apart from one another about the circumference of the plating wheel, the ribs being configured to engage the workpiece to space the workpiece apart from the exterior face of the cylindrical wall by an air gap, wherein the ribs are discrete from the opening of the cylindrical wall;

an external anode located proximate to and positioned outside the cylindrical wall of the plating wheel to define an electroplating work area therebetween; and an internal anode held within the interior chamber of the plating wheel and positioned to align with the work area.

2. The system according to claim 1, wherein the external anode comprises an annular face that faces the exterior face of the cylindrical wall.

3. The system according to claim 1, wherein the plating wheel rotates about an axis of rotation at a center of the cylindrical wall, the external anode comprising an annular face that is concentrically aligned with the cylindrical wall about the axis of rotation.

4. The system according to claim 1, wherein the cylindrical wall extends about a circumference of the plating wheel, the external anode extending partially along the circumference of the plating wheel.

5. The system according to claim 1, wherein the external anode extends around an electroplating section of the cylindrical wall of the plating wheel.

6. The system according to claim 1, wherein the external anode comprises an annular face that face the exterior face of the cylindrical wall, the annual face of the external anode being spaced radially apart from the exterior face of the cylindrical wall to define the work area therebetween.

7. The system according to claim 1, wherein the external anode and the plating wheel are mounted on a base, the plating wheel rotating relative to the base about an axis of rotation, the external anode being held stationary relative to the base as the plating wheel rotates about the axis of rotation.

8. The system according to claim 1, wherein the external anode comprises a mesh structure configured to allow electroplating solution sprayed through the opening from the interior chamber of the plating wheel to flow through the external anode.

9. An electroplating system comprising:

a plating wheel having a side and a cylindrical wall extending from the side, the cylindrical wall comprising an exterior face extending about a circumference of the plating wheel, the plating wheel having an interior chamber that at least partially defines a solution chamber that is configured to hold an electroplating solution, the cylindrical wall comprising openings extending through the cylindrical wall into fluid communication with the interior chamber;

a workpiece held by the plating wheel; and ribs extending outwardly from the exterior face of the cylindrical wall, the ribs being spaced apart from one another about the circumference of the plating wheel, the ribs being engaged with the workpiece such that the workpiece is spaced apart from the exterior face of the cylindrical wall by an air gap between the workpiece and the exterior face of the cylindrical wall, wherein the ribs are discrete from the openings of the cylindrical wall.

10. The system according to claim 9, wherein the cylindrical wall extends about an axis of rotation, the ribs being oriented to extend in a direction generally parallel to the axis of rotation.

11. The system according to claim 9, wherein at least one of the ribs is positioned to overlap an intermediate section of the exterior face.

12. The system according to claim 9, wherein the cylindrical wall intersects the side at a top edge and includes a bottom edge that is opposite the top edge, a flange extends outwardly from the exterior face of the cylindrical wall proximate the top edge, the ribs extending between the flange and the bottom edge.

13. The system according to claim 9, wherein the ribs comprise exterior surfaces that are spaced apart from the exterior face of the cylindrical wall.

14. The system according to claim 9, wherein the ribs have a rectangular shape.

15. The system according to claim 9, wherein a flange extends outwardly from the exterior face of the cylindrical wall, the flange being engaged with the workpiece to create the air gap between the workpiece and the exterior face of the cylindrical wall.

16. The system according to claim 9, further comprising an internal anode held within the interior chamber of the plating wheel.

17. The system according to claim 9, further comprising an external anode facing the cylindrical wall of the plating wheel.

18. An electroplating system comprising:

a plating wheel having a side and a cylindrical wall extending from the side, the cylindrical wall comprising an exterior face, the plating wheel having an interior chamber that at least partially defines a solution chamber that is configured to hold an electroplating solution, the cylindrical wall comprising an opening extending through the cylindrical wall into fluid communication with the interior chamber; and a workpiece held by the plating wheel, wherein the plating wheel comprises ribs that extend outwardly from the exterior face of the cylindrical wall and engage the workpiece such that the workpiece is spaced apart from the exterior face of the cylindrical wall of the plating wheel by an air gap, the ribs being discrete from the opening of the cylindrical wall.

19. The system according to claim 18, wherein a flange extends outwardly from the exterior face of the cylindrical wall, the flange being engaged with the workpiece such that the workpiece is spaced apart from the exterior face of the cylindrical wall by the air gap.

20. The system according to claim 9, wherein the openings of the cylindrical wall do not extend through the ribs.

* * * * *